US008334744B1

(12) United States Patent
Tibbetts

(10) Patent No.: US 8,334,744 B1
(45) Date of Patent: Dec. 18, 2012

(54) TETHER CABLE WITH INCREASED THERMAL DISSIPATION AND METHOD OF TETHERING AN UNDERWATER VEHICLE

(75) Inventor: Paul D. Tibbetts, Palm City, FL (US)

(73) Assignee: Lockheed Martin Company, Bethesda, MD (US)

( * ) Notice: Subject to any disclaimer, the term of this patent is extended or adjusted under 35 U.S.C. 154(b) by 471 days.

(21) Appl. No.: 12/700,969

(22) Filed: Feb. 5, 2010

(51) Int. Cl.
*H01F 27/30* (2006.01)

(52) U.S. Cl. ..... 336/198

(58) Field of Classification Search ..... 336/65, 336/196, 198; 114/242–254
See application file for complete search history.

(56) References Cited

U.S. PATENT DOCUMENTS 4,324,195 A * 4/1982 Cunningham et al. ..... 114/312
6,257,162 B1 * 7/2001 Watt et al. ..... 114/244
6,988,854 B2 * 1/2006 Porter ..... 405/165

* cited by examiner

*Primary Examiner* — Tuyen Nguyen
(74) *Attorney, Agent, or Firm* — Simpson & Simpson, PLLC

(57) ABSTRACT

A tether system for an underwater vehicle, including: a drum including a substantially cylindrical spooling segment, the spooling segment including: an axially aligned first portion with an outer circumference including a first opening; and a second portion at an axial end of the first portion and including a second opening. The system also includes a tether cable connected to the storage drum. The first and second openings form a portion of a passage from an exterior of the drum through the first portion to the outer circumference of the first portion. A tether cable for an underwater vehicle, including: a core including conductive wire or optical fiber and a buoyant jacket surrounding the core of conductive material. The buoyant jacket includes a plurality of first portions with a first outside diameter and a plurality of second portions having respective second outside diameters less than the first outside diameter.

9 Claims, 3 Drawing Sheets

TETHER CABLE WITH INCREASED THERMAL DISSIPATION AND METHOD OF TETHERING AN UNDERWATER VEHICLE

FEDERALLY SPONSORED RESEARCH OR DEVELOPMENT

The U.S. Government has a paid-up license in this invention and the right in limited circumstances to require the patent owner to license others on reasonable terms as provided for by the terms of Government Agency Contract No. 06G6403.

FIELD OF THE INVENTION

The present invention relates generally to a tether cable for an underwater vehicle with increased thermal dissipation capacity.

BACKGROUND OF THE INVENTION

The prior art teaches that heat generated by a spooled tether cable for an underwater vehicle must be conducted to the exterior of the drum where the heat is then dissipated. The cable jacket material, winding tension, and the exact positioning of the cable on the drum serves to trap fluid around the cable. Therefore, the prior art teaches that fluid surrounding the drum only impacts the exterior of the drum and that fluid trapped between spooled cable segments is substantially static and of nominal value in cooling the spooled cable.

BRIEF SUMMARY OF THE INVENTION

The present invention broadly comprises a tether system for an underwater vehicle, including: a drum including a substantially cylindrical spooling segment, the spooling segment including: an axially aligned first portion with an outer circumference including a first opening; and a second portion at an axial end of the first portion and including a second opening. The system also includes a tether cable connected to the storage drum. The first and second openings form a portion of a passage from an exterior of the drum through the first portion to the outer circumference of the first portion.

The present invention also broadly comprises a tether system for an underwater vehicle, including a drum including a substantially cylindrical spooling segment and a tether cable connected to the storage drum and including a buoyant jacket with a plurality of circumferential slots. When the tether cable is at least partially wound about the first portion, respective segments of the tether cable are in contact one with the other, respective open spaces are formed between the respective segments, and a slot from the plurality of slots forms a passageway connecting the respective first open spaces.

The present invention further broadly comprises a tether cable for an underwater vehicle, including: a core including conductive wire or optical fiber and a buoyant jacket surrounding the core of conductive material. The buoyant jacket includes a plurality of first portions with a first outside diameter and a plurality of second portions having respective second outside diameters less than the first outside diameter.

The present invention broadly comprises a method of tethering an underwater vehicle, including: coiling a portion of a tether cable about a substantially cylindrical spooling segment of a drum. The spooling segment includes an axially aligned first portion with an outer circumference including a first opening and a second portion at an axial end of the first portion and including a second opening. The method also contacts respective segments of the tether cable with the outer circumference and forming a passage from an exterior of the drum through the first and second openings to the outer circumference of the first portion.

The present invention also broadly comprises a method of tethering an underwater vehicle, including: coiling a portion of a tether cable about a substantially cylindrical spooling segment of a drum, the tether cable including a buoyant jacket with a plurality of circumferential slots; contacting first segments of the tether cable one with the other; forming respective first spaces between the first segments of the tether cable; and connecting the respective first spaces with a slot from the plurality of slots.

The present invention further broadly comprises a method for fabricating a tether cable for an underwater vehicle, including: producing a tether cable segment with an outer jacket, the outer jacket providing a first buoyancy for the tether cable; and removing a plurality of circumferential segments from the outer jacket such that the tether cable has a second buoyancy, different than the first buoyancy.

A general object of the present invention is to provide a tether cable and tethering system with improved cooling of the cable.

This and other objects, features and advantages of the present invention will become readily apparent to those having ordinary skill in the art from a reading and study of the following detailed description of the invention, in view of the drawing and appended claims.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspects.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described.

Figure 1A:
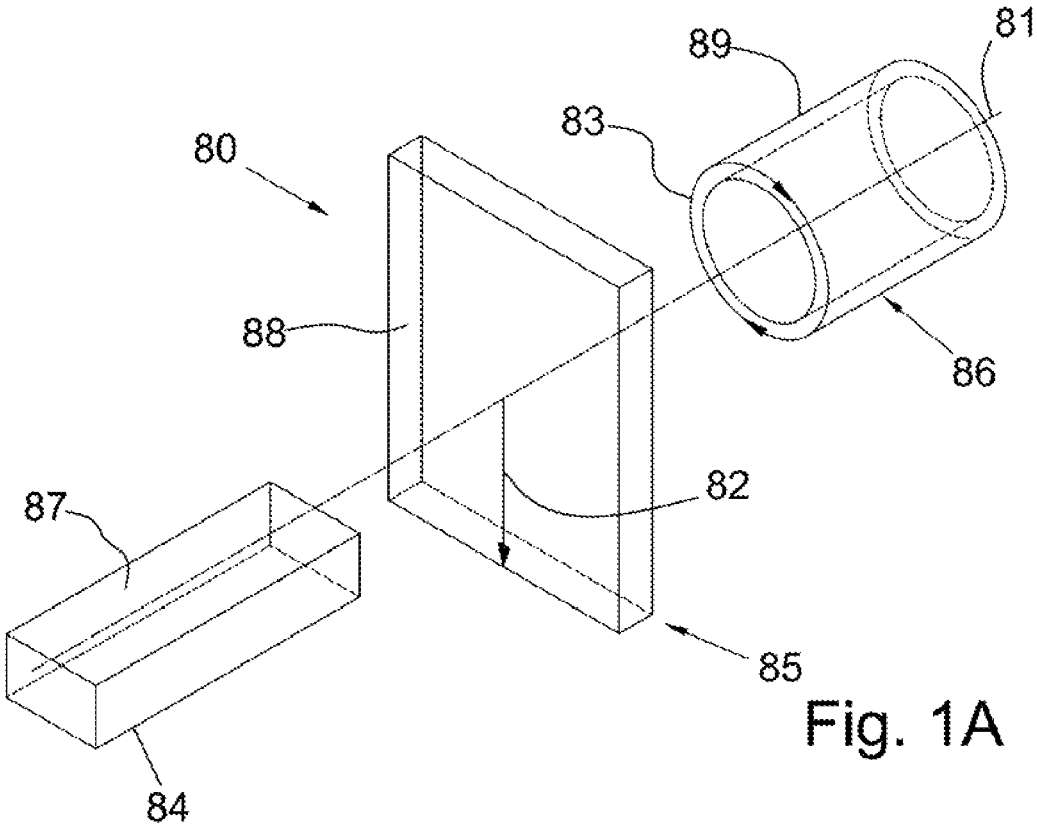
FIG. 1A is a perspective view of a cylindrical coordinate system demonstrating spatial terminology used in the present application.

FIG. 1A is a perspective view of cylindrical coordinate system 80 demonstrating spatial terminology used in the present application. The present invention is at least partially described within the context of a cylindrical coordinate system. System 80 has a longitudinal axis 81, used as the reference for the directional and spatial terms that follow. The adjectives "axial," "radial," and "circumferential" are with respect to an orientation parallel to axis 81, radius 82 (which is orthogonal to axis 81), and circumference 83, respectively. The adjectives "axial," "radial" and "circumferential" also are regarding orientation parallel to respective planes. To clarify the disposition of the various planes, objects 84, 85, and 86 are used. Surface 87 of object 84 forms an axial plane. That is, axis 81 forms a line along the surface. Surface 88 of object 85 forms a radial plane. That is, radius 82 forms a line along the surface. Surface 89 of object 86 forms a circumferential plane. That is, circumference 83 forms a line along the surface. As a further example, axial movement or disposition is parallel to axis 81, radial movement or disposition is parallel to radius 82, and circumferential movement or disposition is parallel to circumference 83. Rotation is with respect to axis 81.

The adverbs "axially," "radially," and "circumferentially" are with respect to an orientation parallel to axis 81, radius 82, or circumference 83, respectively. The adverbs "axially," "radially," and "circumferentially" also are regarding orientation parallel to respective planes.

Figure 1B:
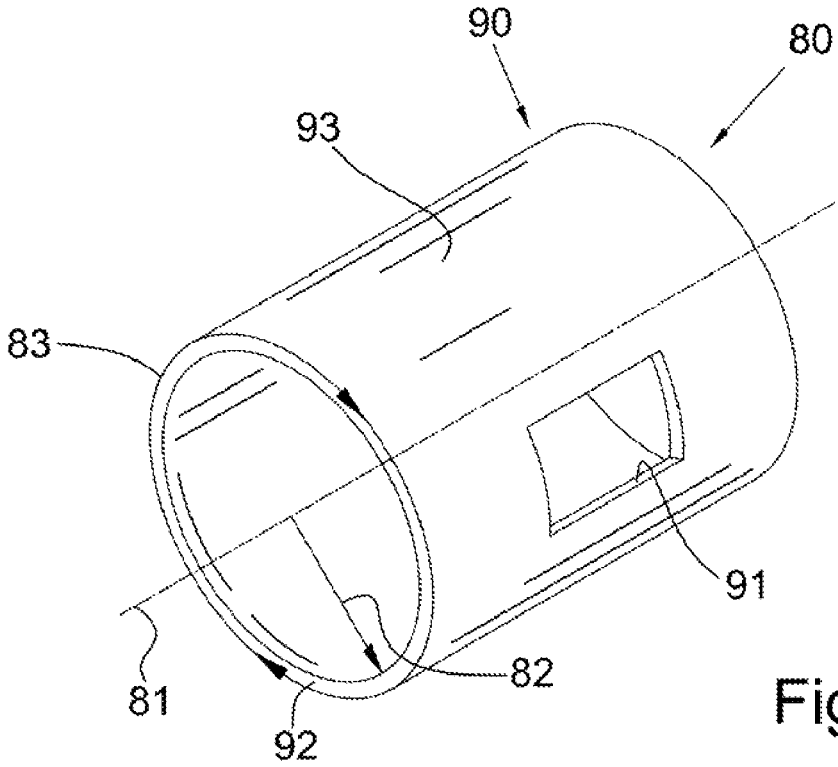
FIG. 1B is a perspective view of an object in the cylindrical coordinate system of FIG. 1A demonstrating spatial terminology used in the present application.

FIG. 1B is a perspective view of object 90 in cylindrical coordinate system 80 of FIG. 1A demonstrating spatial terminology used in the present application. Cylindrical object 90 is representative of a cylindrical object in a cylindrical coordinate system and is not intended to limit the present invention in any manner. Object 90 includes axial surface 91, radial surface 92, and circumferential surface 93. Surface 91 is part of an axial plane, surface 92 is part of a radial plane, and surface 93 is part of a circumferential plane.

Figure 2:
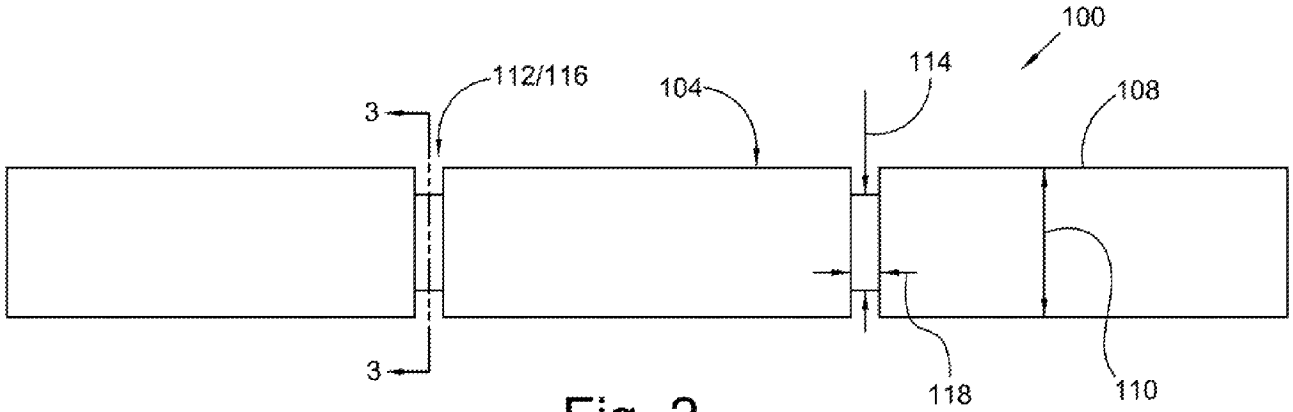
FIG. 2 is a side view of a portion of a tether cable.

FIG. 2 is a side view of tether cable 100.

Figure 3:
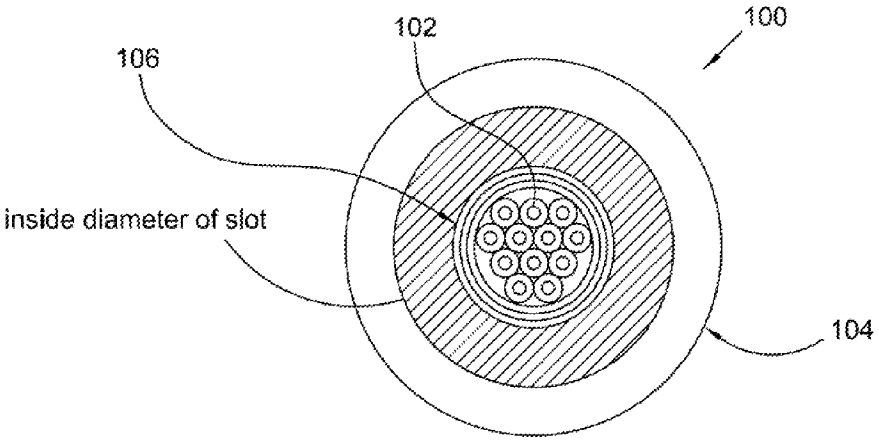
FIG. 3 is a cross section of the tether cable in FIG. 2, generally through line 3-3 in FIG. 2; and, FIG. 4 is a cross-sectional view of a drum system for spooling the tether cable of FIG. 2.

FIG. 3 is a cross section of tether cable 100 in FIG. 2, generally through line 3-3 in FIG. 2. The following should be viewed in light of FIGS. 2 and 3. In the discussion that follows, the terms "tether cable," "tether," and "cable," are used interchangeably. Tether cable design for an underwater vehicle involves tradeoffs between the area of the electrical conductors in the tether, for example copper conductors 102; the heat dissipated by resistive losses from the conductors within the cable; the buoyancy of the tether required to maintain neutral buoyancy; and the heat flow mechanism through a jacket for the tether, for example, jacket 104, from the conductors to the surrounding environment. Advantageously, cable 100 enables increased heat flow, as described infra, when the cable is spooled, while maintaining reasonable dimensions for the cable.

Cable 100 includes core 106 including any combination of electrical conductors, for example, conductors 102, fiber optic cable, insulation, and filler known in the art. Buoyant jacket 104 surrounds core 106. Jacket 104 is made of any buoyant material known in the art. In one embodiment, the material is thermoplastic rubber with a specific gravity of 0.88. The jacket includes a plurality of portions 108 with an outside diameter 110 and a plurality of portions 112 having respective outside diameters 114 less than outside diameter 110. In one embodiment the respective diameters 114 are all equal. Thus, portions 112 form circumferential slots 116 in cable 100. 'Width 118 of the slots can be the same for all the slots or can vary among the slots. In one embodiment, the tether cable is initially manufactured with excess buoyancy, as provided by the jacket, for its intended environment, typically seawater. The circumferential slots are then made in the buoyant jacket material. The amount of material removed and the spacing between slots is determined such that the cable attains the required buoyancy. In one embodiment, the required buoyancy is neutral.

Figure 4:
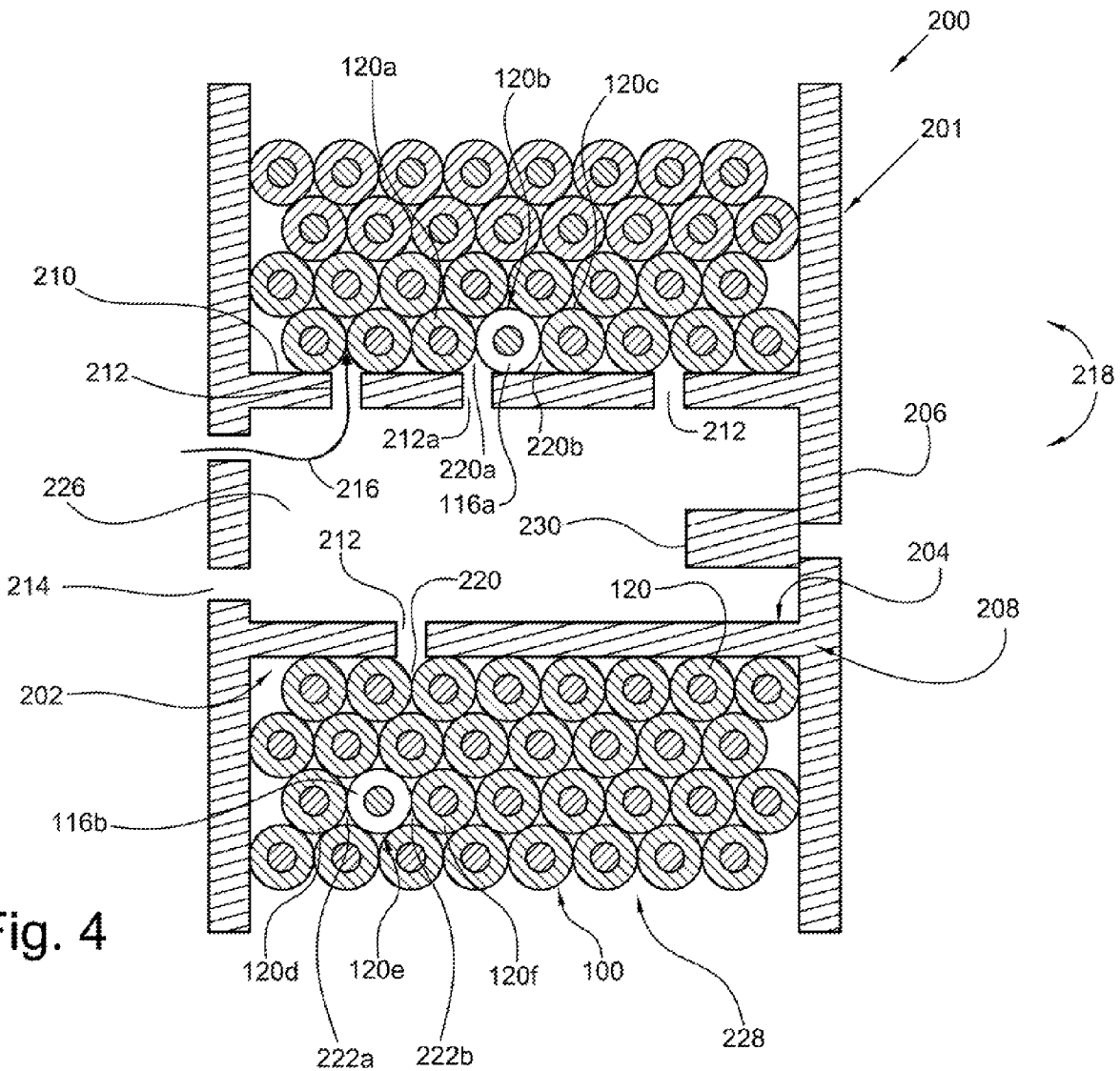

FIG. 4 is a cross-sectional view of drum system 200 for spooling tether cable 100 of FIG. 2. System 200 includes drum 201 with substantially cylindrical spooling segment 202. The spooling segment includes axially aligned portion 204 and portion 206 at axial end 208 of portion 204. Note that there are two axial ends 208. Portion 204 includes outer circumference 210 with at least one opening 212. Portion 206 includes at least one opening 214. Cable 100 is connected to the drum. Openings 212 and 214 form a portion of passage 216 from exterior 218 of the drum through the portion 204 to outer circumference 210. The passage continues to the outer circumference of the spooled cable as described infra. The function of the openings and passage are further described infra.

In an example embodiment, when the tether cable is at least partially wound about portion 204, for example, as shown in FIG. 4, respective segments 120 of the tether cable are in contact with outer circumference 210: respective spaces 220 are formed between two respective segments and outer circumference 210, and respective opening 212 are continuous with space 220. That is, a flow path from the exterior of the drum to the coiled tether cable is formed. Thus, ambient water flows along the path to the tethered coil, providing cooling for the coiled cable.

Axially adjacent spaces, for example, spaces 220*a* and 220*b* are formed between respective segments 120, for example, segments 120*a*-120*c* and outer circumference 210. In an example embodiment, one or more slots 116, for example, slot 116*a*, form respective passageways between axially adjacent spaces 220. The passageways enable the flow of cooling fluid between the adjacent spaces 220. For example, the passageway formed by slot 116*a* enables flow of cooling fluid from space 226 through slot 212*a* to spaces 220*a* and 220*b*, cooling segments 120*a*-120*c*.

When the tether cable is at least partially wound about portion 204, respective segments of the tether cable, not in contact with circumference 210, are in contact, for example, segments 120*d*-120*f*. Respective open spaces 222, for example, spaces 222*a* and 222*b*, are formed between the respective segments. In an example embodiment, one or more slots 116, for example, slot 116*b*, form passageways connecting open spaces 222. The passageways enable the flow of cooling fluid between the adjacent spaces 222. Thus, due to openings 212, spaces 220 and 222, and the slots connecting spaces 220 and 222, a flow of cooling liquid is enabled from space 226 to outer circumference 228 of the coiled cable, greatly increasing the thermal dissipation of the coiled cable.

In an example embodiment, system 200 includes pump 230 for drawing fluid through an opening 214. That is, the pump injects water into space 226 formed by segment 204, forcing water through openings 212 to increase the cooling of the spooled tether cable. Pump 230 can be any pump known in the art.

Advantageously, cable 100 and system 200 increase the flow of cooling fluid through a spooled tether cable by providing additional openings and flow paths to connect passageways in the spooled cable formed by open spaces, such as spaces 220 and 222 between adjacent/contacting cable segments. In system 200, fluid from outside of the drum flows through openings 214 (either by natural convection or by pumping) into space 226 and through openings 212 to the spooled cable. Advantageously, slots 116 in cable 100 connect various openings and passageways in the spooled cable, for example, openings 220 and 222, proving a network of openings and passageways connecting circumference 210 with outer circumference 228 of the coiled cable and the exterior of the drum. Cooling fluid flows radially outward from segment 204 through the network, increasing the cooling of the spooled cable. For example, cooling fluid flows through opening 212*a* into space 220*a*. From space 220*a*, the fluid flows through an opening 222 in contact with segments 120*a* and 120*b* until the fluid reaches another slot 116 (not shown) and then flows outward to a radially adjacent space between cable segments and in communication with the previously mentioned slot. This pattern is repeated until the cooling fluid reaches the outer circumference of the coiled cable.

It should be understood that drum 201 is not limited to any particular number, size, shape, or configuration of openings 212 and 214. To simplify the presentation, only two slots 116 are shown in the spooled cable in FIG. 5. It should be understood that other numbers of slots can be present in a cross-section of cable spooled about drum 201.

According to aspects illustrated herein, there is provided a method for tethering an underwater vehicle. The method includes: coiling a portion of a tether cable about a substantially cylindrical spooling segment of a drum. The spooling segment includes: an axially aligned first portion with an outer circumference including a first opening; and a second portion at an axial end of the first portion and including a second opening. The method also contacts respective segments of the tether cable with the outer circumference; and forms a portion of a passage from an exterior of the drum through the first portion to the outer circumference of the first portion and including the first and second openings.

In one embodiment, contacting respective segments of the tether cable with the outer circumference includes forming a space between two respective segments and the outer circumference, and the method includes aligning the first opening with the space. In one embodiment: the tether cable includes a buoyant jacket with a plurality of circumferential slots; and contacting respective segments of the tether cable with the outer circumference includes forming two axially adjacent spaces between respective segments and the outer circumference. The method includes forming a passageway between the two axially adjacent spaces with a slot from the plurality of slots.

In one embodiment: the tether cable includes a buoyant jacket with a plurality of circumferential slots; coiling a portion of a tether cable includes placing respective segments of the tether cable in contact one with the other, and the method includes: forming respective open spaces between the respective segments; and connecting the respective spaces with slots from the plurality of slots. In one embodiment, the method includes pumping fluid through the passage.

According to aspects illustrated herein, there is provided a method for tethering an underwater vehicle. The method includes: coiling a portion of a tether cable about a substantially cylindrical spooling segment of a drum. The tether cable includes a buoyant jacket with a plurality of circumferential slots. The method also includes: contacting segments of the tether cable one with the other; forming respective spaces between the segments of the tether cable; and connecting the respective spaces with slots from the plurality of slots.

In one embodiment, the spooling segment includes: an axially aligned first portion with an outer circumference including a first opening; and a second portion at an axial end of the first portion and including a second opening. The method includes forming part of a fluid flow path from an exterior of the drum through the first portion to the outer circumference of the first portion including the first and second openings. In one embodiment: coiling a portion of a tether cable includes contacting respective segments of the tether cable with the outer circumference; and forming respective spaces includes forming a portion of an open space with the outer circumference. The method also includes positioning the open space to be continuous with the first opening. In one embodiment, the method also includes pumping fluid through the fluid flow path.

According to aspects illustrated herein, there is provided a method fabricating a tether cable for an underwater vehicle, including: producing a tether cable segment with an outer jacket, the outer jacket providing a first buoyancy for the tether cable; and removing a plurality of circumferential segments from the outer jacket such that the tether cable has a second buoyancy, different than the first buoyancy.

It should be understood that a present invention device is not limited to the configuration shown in the figures. For example, different numbers and configurations of components can be used to obtain the claimed invention.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What I claimed is:

1. A tether system for an underwater vehicle, comprising:

a drum including a substantially cylindrical spooling segment, the spooling segment including:

an axially aligned first portion with an outer circumference including a first opening; and, a second portion at an axial end of the first portion and including a second opening; and, a tether cable connected to the storage drum, wherein the first and second openings form a portion of a passage from an exterior of the drum through the first portion to the outer circumference of the first portion.

2. The tether system of claim 1, wherein when the tether cable is at least partially wound about the first portion of the spooling segment and respective segments of the tether cable are in contact with the outer circumference:

a space is formed between two respective segments and the outer circumference; and, the first opening is continuous with the space.

3. The tether system of claim 1, wherein:

the tether cable includes a buoyant jacket with a plurality of circumferential slots; and, when the tether cable is at least partially wound about the first portion of the spooling segment and respective segments of the tether cable are in contact with the outer circumference:

two axially adjacent spaces are formed between respective segments and the outer circumference; and, a slot from the plurality of slots forms a passageway between the two axially adjacent spaces.

4. The tether system of claim 1, wherein:

the tether cable includes a buoyant jacket with a plurality of circumferential slots; and, when the tether cable is at least partially wound about the first portion of the spooling segment and respective segments of the tether cable are in contact one with the other:

open spaces are formed between the respective segments; and, a slot from the plurality of slots forms a passageway connecting the open spaces.

5. The tether system of claim 1, further comprising a pump for increasing fluid flow through the first opening.

6. A tether system for an underwater vehicle, comprising:

a drum including a substantially cylindrical spooling segment; and, a tether cable connected to the storage drum and including a buoyant jacket with a plurality of circumferential slots, wherein:

when the tether cable is at least partially wound about the first portion, respective first segments of the tether cable are in contact one with the other;

respective first open spaces are formed between the respective first segments; and, a slot from the plurality of slots forms a passageway connecting the respective first open spaces.

7. The tether system of claim 6, wherein:

the spooling segment includes:

an axially aligned first portion with an outer circumference including a first opening; and, a second portion at an axial end of the first portion and including a second opening; and, the first and second openings form a portion of a passage from an exterior of the drum through the first portion to the outer circumference of the first portion.

8. The tether system of claim 7, wherein when the tether cable is at least partially wound about the first portion and respective second segments of the tether cable are in contact with the outer circumference:

the outer circumference forms a second open space with the respective second segments; and, the first opening is continuous with the second open space.

9. The tether system of claim 6, further comprising a fluid pump for increasing fluid flow through the first opening, or wherein the tether cable has neutral buoyancy.

* * * * *